US006999051B2

(12) United States Patent
Hsu

(10) Patent No.: US 6,999,051 B2
(45) Date of Patent: Feb. 14, 2006

(54) LIGHT-ON AGING TEST SYSTEM FOR FLAT PANEL DISPLAY

(75) Inventor: Yu-Yun Hsu, Hsinchu (TW)

(73) Assignee: Toppoly Optoelectronics Corp., Miao-Li (TW)

( * ) Notice: Subject to any disclaimer, the term of this patent is extended or adjusted under 35 U.S.C. 154(b) by 392 days.

(21) Appl. No.: 10/458,245

(22) Filed: Jun. 11, 2003

(65) Prior Publication Data

US 2004/0252090 A1 Dec. 16, 2004

(51) Int. Cl.
*G09G 3/36* (2006.01)

(52) U.S. Cl. ..... 345/87; 345/211; 324/770

(58) Field of Classification Search ..... 345/84, 345/87, 98, 204, 211, 212; 324/537, 750, 324/763, 770, 771
See application file for complete search history.

(56) References Cited

U.S. PATENT DOCUMENTS

| | | | | |
|---|---|---|---|---|
| 6,229,325 | B1 * | 5/2001 | Browning et al. | 324/760 |
| 6,275,061 | B1 * | 8/2001 | Tomita | 324/770 |
| 6,292,182 | B1 * | 9/2001 | Park et al. | 345/211 |
| 2002/0158656 | A1 * | 10/2002 | Neeb | 324/771 |

* cited by examiner

*Primary Examiner*—Regina Liang
(74) *Attorney, Agent, or Firm*—Bacon & Thomas, PLLC

(57) ABSTRACT

A light-on aging test system electrically connected with a plurality of flat panel displays for conducting aging test to the flat panel displays, which includes at least a signal generator for generating a power signal and a first control signal, at least a signal regulating circuit electrically connected with the signal generator for regulating the first control signal into a second control signal according to an examination condition, and a voltage boosting circuit electrically connected with the signal regulating circuit for boosting the signal level and driving capability of the power signal and the second control signal. The boost power signal is outputted to drive the flat panel displays and the second control signal is inputted to the flat panel displays to perform light-on aging test to the flat panel displays.

9 Claims, 2 Drawing Sheets

LIGHT-ON AGING TEST SYSTEM FOR FLAT PANEL DISPLAY

FIELD OF THE INVENTION

The present invention is related to a test system for a flat panel display, and more particularly to a light-on aging test system for a flat panel display.

BACKGROUND OF THE INVENTION

With the upsurge of consumerism, the requirements imposed on the quality of an electronic product on the market is more and more strict. The designers as well as manufacturers of liquid crystal display (LCD) now not only have to put more attentions in product design but have to think up a way of improving the production efficiency and yield. For a manufacturer of a flat panel display, and more particularly a liquid crystal display (LCD), the lifecycle of product is always the crucial factor that the proprietors are contriving to extend its duration. Burn-in test provides an trustworthy approach for the LCD manufacturers to get through certifications of product quality and raise the reliability of product. Products that are approbated through burn-in test can ensure a high reliability and a prolonged lifecycle, and more importantly, the ex-factory products that are approbated through burn-in test can ensure a low failure ratio.

Because a LCD panel is apt to enter breakdown after an uncertain period of time during operation, there has been proposed a light-on aging tester to take remedial steps to correct such shortcomings. For the purpose of accelerating the aging process of defective LCD products during burn-in test and weeding out these defective products during test, a light-on aging step is necessarily required as a bulwark of the reliability of products for providing the manufacturers with a guarantee to satisfy their clients and end users. With such measure, the result of aging test can be examined in a closer fashion to find out the securest scheme to reform the manufacturing process.

With the burgeoning advancement of technology, small-sized low-temperature poly-silicon thin film transistor liquid crystal module (LTPS TFT-LCM) has become a must-have electronic product that is frequently used in daily life. Typically the LTPS TFT-LCM is applied with an information appliance (IA), such as a digital still camera, mobile phone, etc. In order to examine the aging status of LTPS TFT-LCM under various operation environments and conditions, a light-on aging test system will be involved during production test to strengthen the environmental test variables, accelerate the aging of the LTPS TFT-LCM and shorten the aging time of the LTPS TFT-LCM. Further, the statistical data derived from aging test is analyzed to investigate the aging progress of the LTPS TFT-LCM.

Currently, a conventional aging system for flat panel display chiefly includes a field programmable gate array (FPGA) device mounted on a printed circuit board, wherein the printed circuit board is placed within an environmental test cavity and is allowable to be electrically connected to a flat panel display for providing signals and driving voltages required by the flat panel displays, and thereby performs light-on aging tests to the flat panel display.

Thus far, the problem of the disunity among miscellaneous system architectures of information appliance developed by vendors remains unsettled, and have not been standardized yet. The specification of signal sources for use by a flat panel display comes from various aspects, and is feasible for medium-sized or large-sized LCD panel. Until now there has not emerged an appropriate specification of signal sources for use by a LTPS TFT-LCM. The manufacturers of LTPS TFT-LCM have to design a purpose-built FPGA device to accommodate the signal sources and driving voltages for use by a LTPS TFT-LCM. In addition, the driving capability of the signal sources rendered by the existing single FPGA device is limited that serves to drive a single flat panel display only rather than multiple flat panel displays. More disadvantageously, the price of a FPGA device is costly. These adverse factors heighten the cost of a light-on aging test system, and the yield of flat panel display can not be further upgraded because of the inadequate driving capability of the tester.

SUMMARY OF THE INVENTION

A major object of the present invention is to disclose a light-on aging test system for a flat panel display which drives the flat panel display by means of the output signals of a single field programmable gate array (FPGA) device.

A minor object of the present invention is to disclose a light-on aging test system which increase its driving capability by means of a single field programmable gate array (FPGA) device and a plurality of signal regulating circuits, which in turn satisfies the requirement of driving more flat display panels with the benefits of increased yield and lower budget.

To these ends, a light-on aging test system is tendered and electrically connected with a plurality of flat panel displays for conducting light-on aging test to these flat panel displays. The light-on aging test system according to the present invention includes a signal generator for generating a power signal and a first control signal; at least a signal regulating circuit electrically connected with the signal generator for regulating the first control signal into a second control signal according to an examination condition; and at least a voltage boosting circuit electrically connected with the signal regulating circuit for boosting a signal level and driving capability of the power signal and the second control signal, and further drives the plurality of flat panel displays by boosted power signal and performs an light-on aging test to the plurality of flat panel displays by the second control signal.

In accordance with the present invention, the signal generator is a field programmable gate array device for generating the power signal and the first control signal.

In accordance with the present invention, the light-on aging test system is placed in an environmental test cavity.

In accordance with the present invention, the signal generator further provides with a first reference signal that is necessarily required by the internal circuits of the flat panel displays.

In accordance with the present invention, the signal generator further includes an operational amplifying circuit to regulate the signal level of the first reference to output a second reference signal.

In accordance with the present invention, the signal generator further includes a current amplifying circuit to regulate a current gain of the first control signal so as to increase the maximum allowable number of the flat panel displays in which the light-on aging test system is competent to drive.

In accordance with the present invention, the voltage boosting circuit is a DC-to-DC converter.

In accordance with the present invention, the flat panel displays are low-temperature poly-silicon thin film transistor liquid crystal modules.

In accordance with the present invention, the light-on aging test system is constituted by ten sets of signal regulating circuits and a voltage boosting circuit.

In accordance with the present invention, each signal regulating circuit and voltage boosting circuit are enabled to drive at least six pieces of flat panel displays.

The features and advantages of the present invention will become more apparent through the following descriptions with reference to the accompanying drawings, in which:

DETAILED DESCRIPTION OF THE PREFERRED EMBODIMENT

Figure 1:
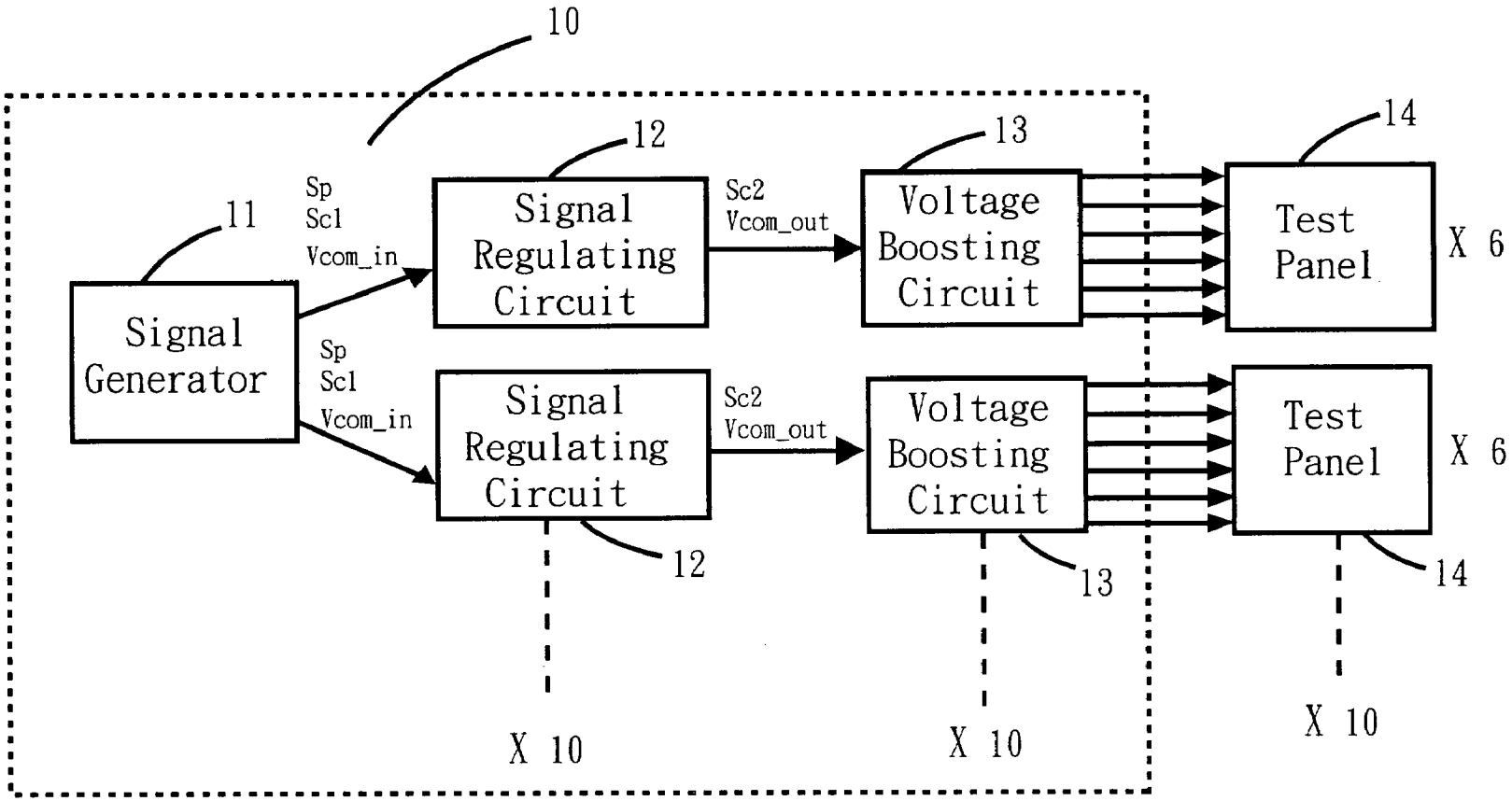
FIG. 1 shows a circuit block diagram of a light-on aging test system for flat panel display according to the present invention.

Please refer to FIG. 1 which shows a circuit block diagram of a light-on aging test system for flat panel display according to the present invention. The preferred embodiment shown in FIG. 1 is sufficient to drive sixty pieces of flat panel display, and it is intended to be taken as a way to exemplify the theorem and principle of the present invention, but not used to limit the scope to be covered by the present invention. However, those of ordinary skill in the art may design an individualized light-on aging test system for flat panel display based on the spirits disclosed herein to fit their needs, while the number of the flat panel displays in which the light-on aging test system is capable to drive can be changed arbitrarily.

As shown in FIG. 1, a light-on aging test system 10 for flat panel display according to the present invention is electrically connected with sixty pieces of flat panel displays 14 and thereby conduct light-on aging test to the flat panel displays 14. The light-on aging test system 10 according to the present invention chiefly includes a signal generator 11, at least a signal regulating circuit 12, and at least a voltage boosting circuit 13, wherein the light-on aging test system 10 and the flat panel displays 14 are placed in an environmental test cavity (not shown).

In this preferred embodiment, the signal generator 11 can be a FPGA device with the examination conditions being predefined by chip designer. The FPGA device is able to generate a plurality of signal sources, including a power signal Sp, a first control signal Sc1 and a first reference signal (Vcom_in). Besides, the signal regulating circuits 12 are respectively connected with the signal generator 11, and each signal regulating circuit 12 chiefly includes an operational amplifying circuit and a current amplifying circuit.

Figure 2:
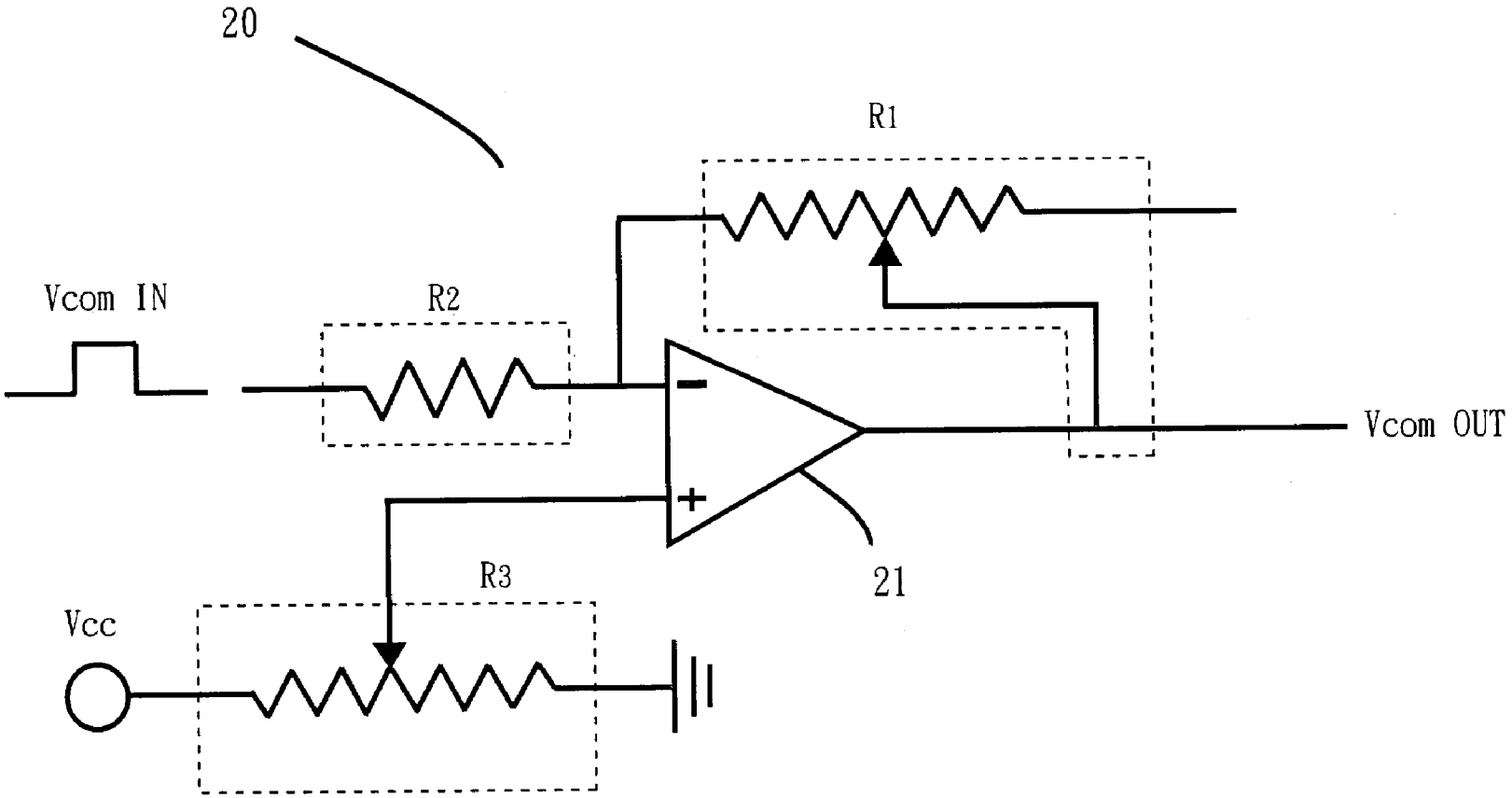
FIG. 2 shows a circuit block diagram of the operational amplifying circuit within the signal regulating circuit shown in FIG. 1.

Both the operational amplifying circuit and the current amplifying circuit can be practically implemented by a circuit design methodology known to the art. Please refer to FIG. 2 which shows a circuit block diagram of the operational amplifying circuit within the signal regulating circuit shown in FIG. 1. As shown in FIG. 2, the operational amplifying circuit 20 regulates the signal level of the first reference signal (Vcom_in) supplied from the signal generator 11 by means of variable resistors R1, R3, a fixed resistor R2, and an operational amplifier 21 according to different examination conditions, and generates a second reference signal (Vcom_out) for outputting to the flat panel displays 14.

In addition, the current amplifying circuit (not shown) mentioned above can be constructed from a plurality of transistors to increase the current gain of the first control signal Sc1 supplied from the signal generator 11 and generate a second control signal Sc2. Under such configuration, the light-on aging test system is capable of driving more flat panel displays. It is appreciated that the circuit design of the current amplifying circuit is well known to the art, and no detailed descriptions are needed to be dwelled here.

Please refer to FIG. 1 again, a plurality of voltage boosting circuits 13 are respectively electrically connected with a corresponding one of the signal regulating circuits 12, and each voltage boosting circuit 13 is electrically connected with a plurality of flat panel displays 14 so as to conduct light-on aging test. It is a preferred arrangement by collocating each voltage boosting circuit 13 with a corresponding signal regulating circuit 12 to drive six pieces of flat panel displays 14 at one time. Each voltage boosting circuit 13 is a DC-to-DC converter that is used to boost the signal level and driving capability of the power signal Sp and the second control signal Sc2 supplied from the signal regulating circuit 12, for example, by boosting the signal level from 3.3 V to 12 V required by the flat panel displays 14. The boosted power signal are outputted to drive the flat panel displays 14, and the second control signal Sc2 is inputted to the flat panel displays 14 to finish light-on aging test.

It is obvious from the above statements that the light-on aging test system 10 according to the present invention basically utilizes the signal sources supplied from a field programmable gate array (FPGA) as well as ten sets of signal regulating circuits 12 and a voltage boosting circuit 13 to regulate and boost the signals supplied from the FPGA to enhance driving capability. Therefore, each signal regulating circuit 12 and the voltage boosting circuit 13 is able to drive six pieces of flat panel displays, and the light-on aging test system 10 according to the present invention is able to drive sixty pieces of flat panel displays 14 cumulatively. It is beyond doubt that the flat panel display adapted to be used with the present invention is a LTPS TFT-LCM.

To conclude, the light-on aging test system according to the present invention can substantially provide the signal sources and driving voltages required to perform light-on aging test to the test flat panel displays, while the signal level and driving capability are competent to increase maximum allowable number of flat panel displays of which the light-on aging test system can cooperate. The light-on aging test system of the present invention only utilizes a single FPGA device to conduct light-on aging tests to a plurality of flat panel display, with a result of a reduced manufacturing cost and a upgraded yield.

While the present invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A light-on aging test system electrically connected with a plurality of flat panel displays for conducting light-on aging test to the plurality of flat panel displays, the light-on aging test system comprising:

a signal generator for generating a power signal and a first control signal;

at least a signal regulating circuit electrically connected with the signal generator for regulating the first control signal into a second control signal according to an examination condition; and at least a voltage boosting circuit electrically connected with the signal regulating circuit for boosting a signal level and driving capability of the power signal and the second control signal, and further drives the plurality of flat panel displays by boosted power signal and performs an light-on aging test to the plurality of flat panel displays by the second control signal.

2. The light-on aging test system of claim 1 wherein the signal generator is a field programmable gate array device.

3. The light-on aging test system of claim 1 wherein the signal generator further provides with a first reference signal as a reference for internal circuits of the plurality of flat panel displays.

4. The light-on aging test system of claim 3 wherein the signal regulating circuit includes an operational amplifying circuit for regulating the first control signal into a second control signal.

5. The light-on aging test system of claim 1 wherein the signal regulating circuit further includes a current amplifying circuit to regulate a current gain of the first control signal so as to increase the number of the flat panel displays in which the light-on aging test system is competent to drive.

6. The light-on aging test system of claim 1 wherein the voltage boosting circuit is a DC-to-DC converter.

7. The light-on aging test system of claim 1 wherein the plurality of flat panel displays are low-temperature polysilicon thin film transistor liquid crystal modules.

8. The light-on aging test system of claim 1 wherein the light-on aging test system is constituted by ten sets of signal regulating circuits and a voltage boosting circuit.

9. The light-on aging test system of claim 8 wherein each signal regulating circuit and voltage boosting circuit are enabled to drive at least six pieces of flat panel displays.

* * * * *